US005592695A

United States Patent [19]

Roche

[11] Patent Number: 5,592,695

[45] Date of Patent: Jan. 14, 1997

[54] GOLF GLOVE

[76] Inventor: Mortimer P. Roche, 8516 Blounts La., Fulton, Md. 20759

[21] Appl. No.: 644,052

[22] Filed: May 10, 1996

Related U.S. Application Data

[63] Continuation-in-part of Ser. No. 530,928, Sep. 29, 1995.

[51] Int. Cl.[6] ..... A41D 19/00

[52] U.S. Cl. ..... 2/161.2; 2/160

[58] Field of Search ..... 2/159, 160, 161.1, 2/161.2, 161.3, 161.4, 163

[56] References Cited

U.S. PATENT DOCUMENTS

| | | | |
|---|---|---|---|
| 2,258,999 | 10/1941 | Nunn . | |
| 2,270,882 | 1/1942 | Link . | |
| 2,379,430 | 7/1945 | Frost | 2/159 |
| 2,456,678 | 12/1948 | Cole | 2/161.2 |
| 2,474,030 | 6/1949 | Braswell . | |
| 2,554,991 | 5/1951 | Kramer | 2/159 |
| 2,751,598 | 6/1956 | Romeo | 2/161.2 |
| 2,782,422 | 2/1957 | Bencriscutto . | |
| 2,928,102 | 3/1960 | Canausa | 2/161.2 |
| 3,255,462 | 6/1966 | Antonious | 2/161.3 |
| 3,740,766 | 6/1973 | Kobylarz | 2/161.2 |
| 3,930,271 | 1/1976 | Kahng | 2/161.2 |
| 4,000,903 | 1/1977 | Swanson . | |
| 4,329,741 | 5/1982 | Bach | 2/161.2 |
| 4,665,565 | 5/1987 | Odom | 2/161.2 |
| 5,028,050 | 7/1991 | Freyer . | |

*Primary Examiner*—Michael A. Neas
*Attorney, Agent, or Firm*—Terrance L. Siemens

[57] ABSTRACT

A golfer's glove for maintaining the golfer's two hands in proper mutual position and maintaining effective grasp of the shaft of a golf club while swinging. The glove has the conventional main portion, four fingers, and a thumb. Novel features include an auxiliary finger chamber for engaging a finger of the hand opposite that wearing the glove, and a seam joining the thumb tightly to the conventional main portion. The auxiliary finger chamber is disposed between the index finger and the middle finger and is dimensioned and configured such that two joints of an inserted finger are restrained therein, and further assures that the two hands remain in proper relation to one another. Restraint of the thumb assists in eliminating uneven or asymmetric pressures exerted on the shaft of the golf club which would distort the swing. The attaching thumb seam extends beyond the knuckle of the index finger to assure no unwanted motion during the swing.

1 Claim, 2 Drawing Sheets

GOLF GLOVE

REFERENCE TO RELATED APPLICATION

This application is a continuation-in-part of Ser. No. 08/530,928 filed on Sep. 29, 1995.

BACKGROUND OF THE INVENTION

1. Field of the Invention

The present invention relates to a glove worn by a golfer. The glove is constructed so as to assure correct proximity of the golfer's hands to one another, and solid grasp of the shaft of the golf club when swinging the club.

2. Description of the Prior Art

Success in golf is based upon control and power in swinging the golf club. In assuring that the swing be effectively executed, appropriate grip upon the shaft of the club must be maintained. When driving, successful characteristics of the grip include tight grasp, and equalized or symmetrical application of pressure throughout all areas of contact with the club.

Many devices have been proposed in the prior art to assist in the accomplishment of proper grip by incorporating restraints, receptacles or auxiliary finger chambers, and the like.

A receptacle, or auxiliary finger chamber, open at both ends for engaging a finger of the hand opposite that wearing the glove is illustrated in U.S. Pat. No. 3,930,271, issued to He Chung Kahng on Jan. 6, 1976. This auxiliary finger chamber is located differently from a similar chamber provided in the present invention. Also, Kahng fails to restrain the thumb, as does the present invention.

Auxiliary finger chambers are also shown in U.S. Pat. Nos. 2,379,430, issued to Norman B. Frost on Jul. 3, 1945, and 2,782,422, issued to Michael Bencriscutto on Feb. 26, 1957. The precise arrangement of the auxiliary finger chamber in the present invention differs from those shown by Frost and Bencriscutto. Frost locates his auxiliary finger chamber near the glove index finger, but not between the index and its neighbor. Also, Frost's auxiliary finger chamber, as disclosed, either is closed at one end, or else is stitched to the neighboring fingers in a manner different from that of the present invention. Bencriscutto's auxiliary chamber is dedicated to the opposing thumb, rather than a finger, and is located in overlying relationship to the palm, rather than adjacent the index finger.

The gloves of Frost and Bencriscutto also fail to restrain the thumb, contrary to the practice of the present invention.

In another significant difference, the prior art auxiliary finger chambers are not specifically dimensioned and configured to cover both knuckles of the finger, as is the case in the present invention.

U.S. Pat. No. 2,928,102, issued to Fred C. Canausa on Mar. 15, 1960, illustrates a golf glove having fingers and thumb open at the ends. Canausa connects the thumb to the main section of the glove by a tab having a snap fastener. In the present invention, the thumb is permanently affixed to the main body of the glove. Canausa lacks the open auxiliary chamber of the present invention.

The thumb is joined to the main body of the glove by a gusset in U.S. Pat. No. 2,751,598, issued to Benjamin B. Romeo on Jun. 26, 1956. The gusset allows for more spacing and play of the thumb than is permitted in the arrangement of the present invention. Romeo lacks the open auxiliary chamber of the present invention.

None of the above inventions and patents, taken either singly or in combination, is seen to describe the instant invention as claimed.

SUMMARY OF THE INVENTION

The present invention provides a glove which holds a golfer's two hands in abutment and in constant relative position when swinging a golf club. The glove also maintains even, symmetrical pressure on the club, so as not to distort the swing.

The glove has an auxiliary finger chamber, or sleeve, for receiving one finger of the hand opposite the hand wearing the glove. The auxiliary sleeve is sufficiently long so that it covers both the first and second joint of the received finger. This opposes excessive flexing of the finger, which could cause loss of control over the club during a swing. Also, the length of the sleeve tends to hold the received finger parallel to the fingers of the hand wearing the glove. The sleeve is also attached firmly along its entire length on both sides to adjacent fingers of the glove. The attachment seam is located above the seam, that is, on the side opposite that of the palm. This assists in preventing excessive flexing, and also opposes separation of the two hands as they clasp the shaft of the golf club.

The sleeve is open at both ends. One open end admits a finger of the hand opposite the hand wearing the glove. The other open end permits this finger to move axially within the sleeve so as to adjust for comfortable fit and positioning regardless of minor variations in finger length. Comfortable fit is important since even a minor variance may cause lack of concentration on the swing.

The thumb of the glove is attached along its entire length to the main body of the glove. Specifically, this attachment extends above the knuckle of the first finger of the hand. This arrangement immobilizes the thumb and maintains the thumb in constant orientation with respect to the palm and the golf club, thus maintaining even and constant pressure of the thumb on the golf club. Even and constant pressure opposes the tendency of an unrestrained thumb to vary pressure on the club. Varying pressure will influence the swing enough to impair accuracy.

Accordingly, it is a principal object of the invention to provide a golfer's glove which improves grasp of a golf club during a swing.

It is another object of the invention to maintain a golfer's two hands in constant orientation with respect to one another as they grasp the shaft of the golf club.

It is a further object of the invention to prevent separation of the golfer's two hands during the swing.

Still another object of the invention is to maintain even and constant pressure on the shaft of the golf club.

An additional object of the invention is to enable comfortable fit and adjustment of a finger within the sleeve.

It is again an object of the invention to immobilize the thumb of the hand with respect to the palm and with respect to the golf club.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
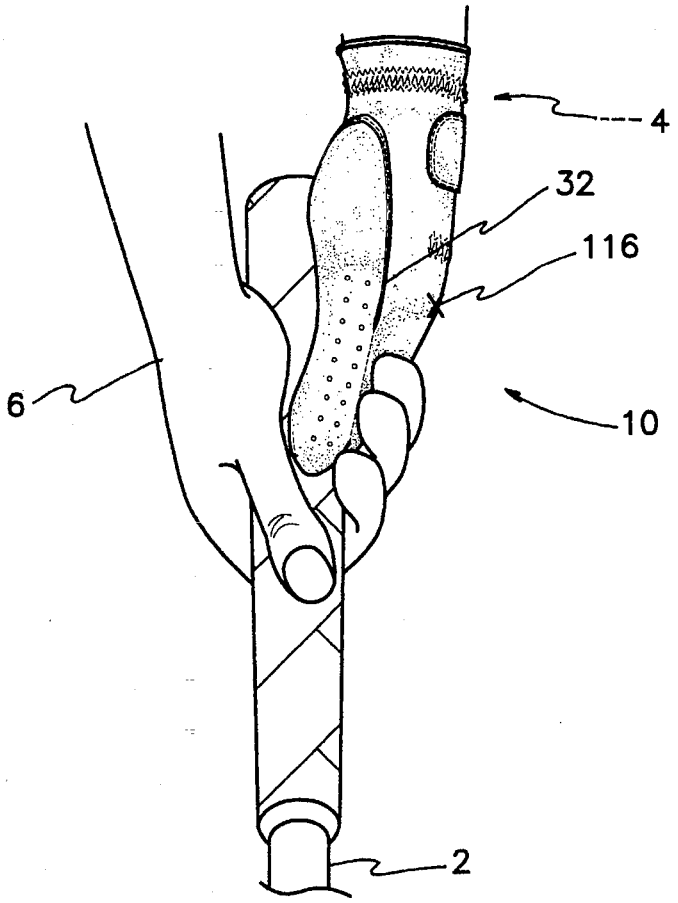
FIG. 1 is an environmental, perspective view of the invention.

FIG. 1 illustrates the novel golfer's glove 10 as it is worn by a user, also illustrating a preferred grasp of the shaft 2 of a golf club (not shown in its entirety). The hands 4,6 of the user encircle shaft 2, hand 4 located just above hand 6, with respect to shaft 2, hands 4,6 in close proximity to one another. Hand 4 will be understood to be that hand wearing glove 10. Hand 6 engages glove 10 by one finger, as discussed hereinafter, and will be referred to as the hand opposite the hand wearing glove 10.

Figure 2:
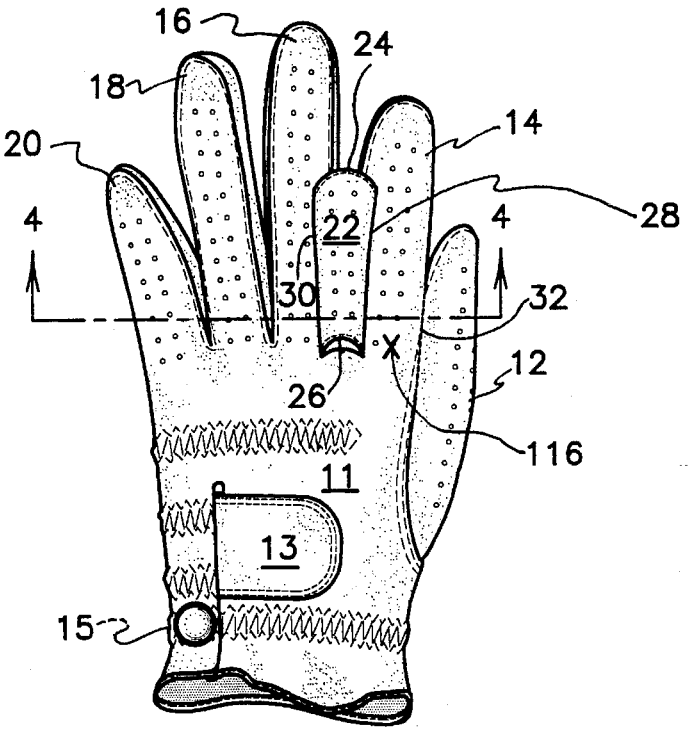
FIG. 2 is a plan view of the invention, illustrating that portion of the novel glove covering the back of the hand of the user.

With reference to FIG. 2, glove 10 is generally of conventional construction, improved by the addition of two novel features. Glove 10 includes a main portion 11 surrounding the palm and central portion of the hand, and is open at the wrist. Glove 10 has conventional thumb pocket 12, and four finger pockets 14, 16, 18, 20, all joined to and projecting from main portion 11. Finger pocket 14 receives the user's index finger, and finger pocket 16 receives the user's long finger.

In a preferred embodiment designed to be adjustable for different users, glove 10 incorporates a tab closure 13 located at the back of glove 10 near the user's wrist. Closure 13 preferably employs hook and loop fastening material. Glove 10 is gathered at the wrist by an elastic band 15.

Thumb and finger pockets 12, 14, 16, 18, 20 are illustrated as being closed at their distal ends. Closed distal ends are not critical, and pockets 12, 14, 16, 18, 20 may be open so that their corresponding thumb and fingers are exposed, if desired.

Turning now to the novel features, a sleeve 22 is located adjacent and parallel to index finger pocket 14. Sleeve 22 is open at its distal end 24 in order to receive a finger of the hand opposite that hand wearing the glove.

Sleeve 22 is dimensioned and configured to cover and enclose two joints of a finger inserted thereinto. These joints are indicated at 112 and 114 in FIG. 3. This length assists in restraining the finger from movement which could adversely affect the swing of the golf club. Specifically, any torsional movement that could cause the opposite hand 6 to lose its position in regards to the club grip indicated in FIG. 1) is discouraged. A manufacturer may consult well known compilations of statistical data regarding ergonometric dimensions and proportions in order to determine an appropriate length of sleeve 22 for each size of golfer's glove 10.

Figure 4:
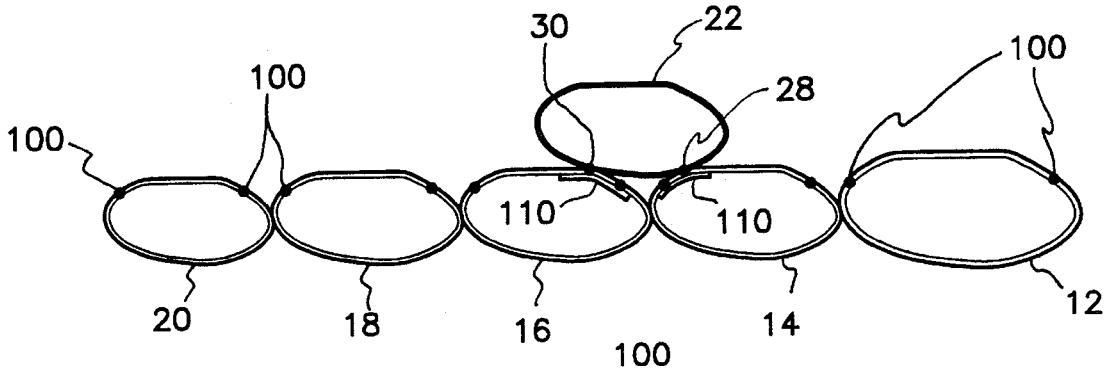
FIG. 4 is a cross sectional view of the novel glove taken along line 4—4 of FIG. 2

Sleeve 22 is located between index finger pocket 14 and middle finger pocket 16, such that pocket 14, sleeve 22, and pocket 16 are arranged in series in this order. This location is thought to position the two hands together best, although other arrangements may be made if desired. For example, pockets 14 and 16 may be adjacent, with sleeve 22 centered just above pockets 14 and 16 and in abutment with both. Turning to FIG. 4 , it can be seen that sleeve 22 is attached above seam 100, seam 100 being the attachment point between the palm engaging portion of the glove and the back portion of the glove. Inside the surface of the glove, as indicated at 110 in FIG. 4, it is contemplated that a piece of extra strengthening material could be attached.

Regardless of the precise arrangement, sleeve 22 is attached to pockets 14 and 16 by seams 28, attaching sleeve 22 to pocket 14, and 30, attaching sleeve 22 to pocket 16. Seams 28 and 30 are located on opposite sides of sleeve 22 in order to assure the preferred linear arrangement of these components. A seam is regarded as a succession of elements binding the material of sleeve 22 to the material of pockets 14 or 16.

A seam may comprise stitches, a bead of adhesive or a spaced apart succession of individual droplets of adhesive, a coil of spiralled wire penetrating the joined elements, a mutual wall if the joined elements are formed from a single, monolithic piece of material, or any other arrangement of periodically located or continuous elements joining sleeve 22 to a pocket 14 or 16.

Thumb pocket 12, in a departure from conventional construction of a glove, is maintained in a position abutting main portion 11 permanently. Connection by a seam of construction described above may be employed. However, the seam 32 joining thumb pocket 12 to main portion 11 is preferably a continuous seam. As employed to secure sleeve 22 to their respective finger pockets 14, 16, seams 28 and 30 need not be continuous, a certain degree of spacing of joining elements being permissible. This is so because when in use, the wearer's fingers tend to maintain parallel orientation of pockets 14 and 16 and sleeve 22.

Figure 3:
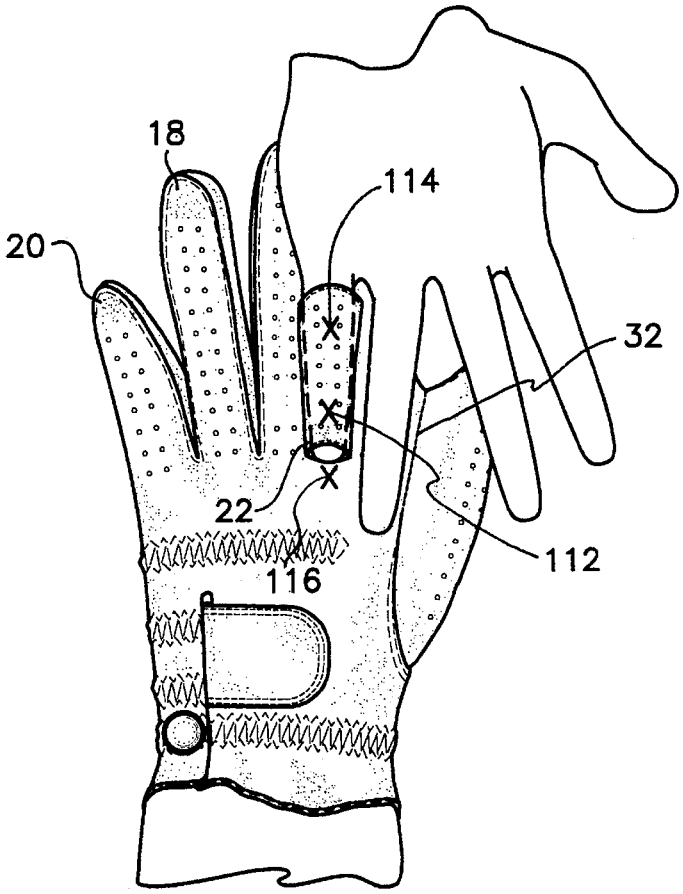
FIG. 3 is a top view of both hands interengaged, but not holding a golf club, with the object being to show the various relationships between the features of the glove and anatomical landmarks of the hands.

In contrast, glove 10 must constrain the wearer's thumb to remain abutting and parallel to the main section of the hand. Therefore, seam 32 must be continuous, or nearly so, and must extend along the entire length of thumb pocket 12. By way of illustration, seams 28 and 30 may comprise two or three points of attachment. However, this number of points of attachment would not be adequate for seam 32, and closely spaced stitching is preferred. Turning to FIG. 3, it is very important that the seam 32 extends beyond knuckle 116 of the first finger of hand 4. This, as in the discussion of the length of sleeve 22 above, is critical in that it prevents weakening of the grip at critical times during the swing along with forcing a beginner or student of the game to feel how a properly held club responds during a swing.

In the preferred embodiment, the small finger, or pinkie, of right hand 6 is disposed between the index and middle fingers of left hand 4 and the small finger of hand 6 occupies sleeve 22 (see FIG. 3).

It will be apparent to those skilled in the art that the novel principles may be employed in embodiments other than the principal embodiment illustrated and described. For example, closure 13 and elastic band 15 may be omitted. Obviously, glove 10 may be dimensioned and configured for different sizes and for both right and left hands.

It is to be understood that the present invention is not limited to the embodiments described above, but encompasses any and all embodiments within the scope of the following claims.

I claim:

1. A golfer's glove for assisting in maintaining effective positioning of the hands and grasp of the shaft of a club when swinging the club, said glove comprising:

a main portion surrounding the central portion of a user's hand;

a thumb pocket and four finger pockets including an index finger pocket and a middle finger pocket, joined to and projecting from said main portion, said thumb pocket maintained abutting said main portion and said index finger pocket by permanent attachment means comprising a continuous seam joining said thumb pocket to said main portion of said golfer's glove and extending at least to a user's inserted index finger first knuckle; and a sleeve for receiving a finger of the hand opposite that wearing said golfer's glove, said sleeve having an open proximal end and an open distal end, said sleeve arranged parallel to said four finger pockets and attached between said index finger pocket and middle finger pocket, said sleeve dimensioned and configured to enclose two finger joints of a user's inserted opposite hand finger, said sleeve having two seams running the full length of opposite sides of said sleeve, one of said two seams attaching said sleeve to an upper surface of said index finger pocket and the other of said two seams attaching said sleeve to an upper surface of said middle finger pocket, said sleeve extending from below outermost finger joints of the inserted user index and middle fingers to the inserted user knuckles at said index finger pocket and said middle finger pocket, wherein said golfer's glove allows the user to maintain an effective grasp of the shaft of the club by preventing the gloved thumb from wrapping around the shaft and by preventing separation of the user's hands by virtue of the restraint of a finger of the user's opposite hand within said sleeve and further encouraging the user's hands to stay in constant orientation with respect to one another.

* * * * *